US005853109A

United States Patent [19]

Elliott

[11] Patent Number: 5,853,109

[45] Date of Patent: Dec. 29, 1998

[54] DISPENSING STRUCTURE WITH DISPLACEABLE PENETRATOR AND BISTABLE COVER ACTUATOR

[75] Inventor: John Elliott, Burlington, Wis.

[73] Assignee: APTARGROUP, Inc., Crystal Lake, Ill.

[21] Appl. No.: 69,480

[22] Filed: Apr. 29, 1998

[51] Int. Cl.[6] ..... B67B 7/00

[52] U.S. Cl. ..... 222/83; 222/556

[58] Field of Search ..... 222/81, 83, 83.5, 222/88, 182, 556

[56] References Cited

U.S. PATENT DOCUMENTS

| | | | |
|---|---|---|---|
| Re. 29,850 | 11/1978 | Labarre . | |
| 2,895,654 | 7/1959 | Rieke . | |
| 3,135,441 | 6/1964 | Wise et al. . | |
| 3,187,918 | 6/1965 | Moore | 222/83 X |
| 3,207,375 | 9/1965 | Bereziat et al. . | |
| 3,239,112 | 3/1966 | Porcelli . | |
| 3,269,617 | 8/1966 | Goth . | |
| 3,278,089 | 10/1966 | Heekin et al. . | |
| 3,282,477 | 11/1966 | Henchert . | |
| 3,292,828 | 12/1966 | Stuart . | |
| 3,310,206 | 3/1967 | Littlefield . | |
| 3,406,872 | 10/1968 | Fiquet et al. . | |
| 3,434,620 | 3/1969 | Laurizio . | |
| 3,458,080 | 7/1969 | Laurizio . | |
| 3,459,315 | 8/1969 | Labarre . | |
| 3,495,746 | 2/1970 | Laurizio . | |
| 3,567,061 | 3/1971 | Song . | |
| 3,580,423 | 5/1971 | Gilman . | |

(List continued on next page.)

FOREIGN PATENT DOCUMENTS

| | | |
|---|---|---|
| 570 276 A1 | 11/1993 | European Pat. Off. . |
| 747 294 A1 | 12/1996 | European Pat. Off. . |
| WO 95/28274 | 10/1995 | WIPO . |
| WO 96/14249 | 5/1996 | WIPO . |
| WO 96/24483 | 8/1996 | WIPO . |
| WO 97/00816 | 1/1997 | WIPO . |
| WO 97/05055 | 2/1997 | WIPO . |

OTHER PUBLICATIONS

"Multi–Material Injection Saves Time, While Cutting Costs," Modern Plastics, Mar. 19, 1994 (Author: Peter Mapleston).

"Molding Many Parts Into One," Product Design and Development, Dec. 19, 1995, p. 16 (Author: Jay Rosenberg).

A copy of 2 photographs of a closure specimen, one photograph showing a top perspective view with the closure open, and the other photograph showing a bottom perspective view with the closure open.

*Primary Examiner*—Kevin P. Shaver

*Attorney, Agent, or Firm*—Rockey, Milnamow & Katz, Ltd.

[57] ABSTRACT

A dispensing structure is provided for a container that has an opening to the container interior which can be initially closed by a membrane occluding the opening. The dispensing structure includes a body for extending around the container opening over the membrane. The body includes a peripheral wall and a flexible panel. The panel is connected with the peripheral wall, extends around a dispensing aperture, is normally biased to an outwardly displaced configuration as viewed from outside the body, and accommodates movement of the panel to an inwardly displaced configuration. The body also includes a penetrator extending inwardly from the panel for penetrating the membrane when the panel is in the inwardly displaced configuration. The dispensing structure also includes a cover for accommodating movement between a closed position over the body and an open position away from the closed position. The cover includes a peripheral frame mounted on the body, and a convex top. The convex top is connected with the peripheral frame, is normally biased to an outwardly convex configuration as viewed from outside the cover, and accommodates flexure of the top to a self-maintained, inverted, inwardly concave configuration for moving the body panel to the inwardly displaced configuration wherein the penetrator penetrates the membrane.

20 Claims, 6 Drawing Sheets

U.S. PATENT DOCUMENTS

| | | | |
|---|---|---|---|
| 3,610,484 | 10/1971 | Matzka . | |
| 3,661,306 | 5/1972 | Kuckens . | |
| 3,706,872 | 12/1972 | Fiquet et al. | 222/83 |
| 3,834,597 | 9/1974 | Guala . | |
| 3,860,152 | 1/1975 | Marti . | |
| 3,912,115 | 10/1975 | Smith . | |
| 3,924,777 | 12/1975 | Peyser . | |
| 3,949,898 | 4/1976 | Patel et al. . | |
| 3,990,603 | 11/1976 | Brochman . | |
| 4,022,357 | 5/1977 | Dwinell . | |
| 4,179,044 | 12/1979 | Fitte . | |
| 4,211,334 | 7/1980 | Witten et al. . | |
| 4,234,103 | 11/1980 | Strobl, Jr. et al. | 222/83.5 |
| 4,294,382 | 10/1981 | Summers et al. . | |
| 4,307,821 | 12/1981 | McIntosh . | |
| 4,340,147 | 7/1982 | McIntosh . | |
| 4,356,939 | 11/1982 | Fitte . | |
| 4,483,464 | 11/1984 | Nomura . | |
| 4,583,665 | 4/1986 | Barriac . | |
| 4,682,702 | 7/1987 | Gach . | |
| 4,696,415 | 9/1987 | Meshberg | 222/83 X |
| 4,709,822 | 12/1987 | Vataru . | |
| 4,722,449 | 2/1988 | Dubach . | |
| 4,727,999 | 3/1988 | Gach . | |
| 4,728,006 | 3/1988 | Drobish et al. . | |
| 4,747,501 | 5/1988 | Greaves . | |
| 4,749,108 | 6/1988 | Dornsbusch et al. . | |
| 4,770,305 | 9/1988 | Su . | |
| 4,785,931 | 11/1988 | Weir et al. . | |
| 4,795,043 | 1/1989 | Odet et al. | 222/83 X |
| 4,807,769 | 2/1989 | Gach . | |
| 4,817,816 | 4/1989 | Leseman et al. . | |
| 4,846,236 | 7/1989 | Deruntz . | |
| 4,867,326 | 9/1989 | O'Meara . | |
| 4,869,399 | 9/1989 | Dubach . | |
| 4,909,434 | 3/1990 | Jones et al. . | |
| 4,948,003 | 8/1990 | Munoz . | |
| 4,969,581 | 11/1990 | Seifert et al. . | |
| 4,976,379 | 12/1990 | Sloan | 222/83 |
| 4,993,569 | 2/1991 | Osip et al. . | |
| 5,005,737 | 4/1991 | Rohr . | |
| 5,008,066 | 4/1991 | Mueller . | |
| 5,042,690 | 8/1991 | O'Meara . | |
| 5,090,582 | 2/1992 | Art et al. . | |
| 5,115,950 | 5/1992 | Rohr . | |
| 5,133,486 | 7/1992 | Moore et al. . | |
| 5,213,236 | 5/1993 | Brown et al. . | |
| 5,228,592 | 7/1993 | Pellerano | 222/83 |
| 5,255,812 | 10/1993 | Hsu . | |
| 5,271,531 | 12/1993 | Rohr et al. . | |
| 5,292,025 | 3/1994 | Dubreul . | |
| 5,356,018 | 10/1994 | Dubach . | |
| 5,386,918 | 2/1995 | Neveras . | |
| 5,400,912 | 3/1995 | Brown et al. . | |
| 5,427,260 | 6/1995 | Mueller et al. . | |
| 5,437,382 | 8/1995 | Gluckman . | |
| 5,439,124 | 8/1995 | Mock . | |
| 5,439,143 | 8/1995 | Brown et al. . | |
| 5,462,200 | 10/1995 | Weiler . | |
| 5,469,980 | 11/1995 | O'Meara et al. . | |
| 5,482,176 | 1/1996 | Maietta et al. . | |
| 5,501,348 | 3/1996 | Takeuchi . | |
| 5,503,282 | 4/1996 | Montgomery . | |
| 5,505,326 | 4/1996 | Junko . | |
| 5,531,363 | 7/1996 | Gross et al. . | |
| 5,547,091 | 8/1996 | Neveras et al. . | |
| 5,566,859 | 10/1996 | Willis et al. . | |
| 5,642,824 | 7/1997 | Hess, III et al. . | |
| 5,711,453 | 1/1998 | Weiler . | |

DISPENSING STRUCTURE WITH DISPLACEABLE PENETRATOR AND BISTABLE COVER ACTUATOR

CROSS REFERENCE TO RELATED APPLICATION(S)

Not applicable.

STATEMENT REGARDING FEDERALLY SPONSORED RESEARCH OR DEVELPOMENT

Not applicable.

REFERENCE TO A MICROFICHE APPENDIX

Not applicable.

TECHNICAL FIELD

This invention relates to a system for dispensing a product from a container. The invention is more particularly related to a dispensing system incorporating a mechanism for opening a membrane which initially covers the opening to the container.

BACKGROUND OF THE INVENTION AND TECHNICAL PROBLEMS POSED BY THE PRIOR ART

Although many types of conventional dispensing closures function generally satisfactorily in applications for which they are designed, it would be desirable to provide an improved dispensing system. With some products, it is desirable to provide a form of air-tight barrier protection to prevent discoloration or spoilage of the product. Thus, it would be desirable to provide an improved dispensing structure incorporating a barrier, such as a membrane, film, or liner. It would also be advantageous to provide an improved system for opening such a barrier in the dispensing structure. Such an improved system should preferably not require the user to first remove a portion of the structure in order to gain access to the barrier or liner.

It would also be beneficial if such an improved dispensing structure could be easily operated to open the barrier in a way that would not generate separate waste materials which would have to be initially handled by the consumer and discarded separately from the dispensing structure or container.

Additionally, it would be desirable to provide such an improved dispensing system with means for readily indicating to the consumer that the dispensing structure has been initially opened or tampered with.

Additionally, it would be desirable to provide an improved dispensing closure that could, if desired, readily accommodate a design in which a frangible sealing system across the dispensing opening can be incorporated solely within a closure structure which is separate from the container to which the closure structure is attached. Advantageously, such a dispensing closure or dispensing structure should provide a very effective seal when the dispensing structure is closed so as to (1) avoid subjecting the material in the container to prolonged exposure to the ambient atmosphere, and (2) prevent contamination of the materials within the container by preventing contaminant ingress.

Such an improved dispensing structure should also accommodate designs which permit incorporation of the dispensing structure as a unitary part, or extension, of the container and which also accommodate mounting of a separate dispensing structure on the container in a secure manner.

It would also be beneficial if such an improved dispensing structure could readily accommodate its manufacture from a variety of different materials.

Further, it would be desirable if such an improved dispensing structure could be provided with a design that would accommodate efficient, high-quality, large volume manufacturing techniques with a reduced product reject rate.

Preferably, the improved dispensing structure should also accommodate high-speed manufacturing techniques that produce products having consistent operating characteristics unit-to-unit with high reliability.

Further, such an improved dispensing system should advantageously accommodate the use of a separate dispensing closure with a variety of conventional containers having a variety of conventional container finishes, such as conventional threaded or snap-fit attachment configurations.

The present invention provides an improved dispensing structure which can accommodate designs having the above-discussed benefits and features.

SUMMARY OF THE INVENTION

According to one aspect of the present invention, a dispensing system or structure is provided for a container that has an opening to the container interior.

According to one aspect of the invention, the dispensing structure is adapted for operatively cooperating with a membrane, such as a liner or other barrier, which is mounted within the dispensing structure. The dispensing structure, with the membrane mounted thereto, is adapted to be attached, either releasably or permanently, to the top of the container.

According to another aspect of the invention, the membrane can be mounted to the container per se across the container opening (e.g., sealingly adhered to the upper edge of the container around the container opening). Then the dispensing structure can be attached, either releasably or permanently, to the container around the membrane.

With either of the above-described two embodiments, the container per se is not a component of the invention. The invention may be characterized as providing a dispensing structure for use with a container, regardless of whether the membrane is mounted directly to the container or directly to part of the dispensing structure.

Further, although it is presently contemplated that the preferred embodiment of the invention employs a dispensing structure which is a separate subassembly manufactured separately from the container, it will be appreciated that the invention also contemplates providing the dispensing structure as an integral part of the container or as a unitary extension of the container.

In the presently contemplated preferred embodiment, the dispensing structure is a separate closure which is adapted to be threadingly engaged with a container or snap-fit onto a container.

The dispensing structure includes a body for extending around the container opening over the membrane, and the membrane may be initially adhered to the container or may be initially mounted within the closure body. The closure body includes a peripheral wall. A flexible panel is connected with the peripheral wall and extends around a dispensing aperture. The flexible panel is normally biased to an outwardly displaced configuration as viewed from outside the body. The flexible panel accommodates movement of the panel to an inwardly displaced configuration.

In a preferred embodiment, the closure body also includes a dispensing spout extending outwardly from the flexible panel around the dispensing aperture. Regardless of whether or not a spout is employed, a penetrator extends inwardly from the panel for penetrating the membrane when the panel is in the inwardly displaced configuration.

The dispensing structure includes a cover for accommodating movement between (1) a closed position over the body, and (2) an open position away from the closed position. The cover further includes a peripheral frame which is adapted to be mounted on the body. The cover includes a convex top that is connected with the frame. The convex top is normally biased to an outwardly convex configuration as viewed from outside the cover. The convex top accommodates flexure of the top to self-maintained, inverted, inwardly concave configuration for moving the body panel to the inwardly displaced configuration wherein the penetrator penetrates the membrane.

In a preferred embodiment, the cover and body are molded together from a thermoplastic material and are connected with a unitary, snap-action hinge.

Numerous other advantages and features of the present invention will become readily apparent from the following detailed description of the invention, from the claims, and from the accompanying drawings.

BRIEF DESCRIPTION OF THE DRAWINGS

In the accompanying drawings forming part of the specification, in which like numerals are employed to designate like parts throughout the same.

DESCRIPTION OF THE PREFERRED EMBODIMENTS

While this invention is susceptible of embodiment in many different forms, this specification and the accompanying drawings disclose only some specific forms as examples of the invention. The invention is not intended to be limited to the embodiments so described, and the scope of the invention will be pointed out in the appended claims.

For ease of description, the dispensing system components of this invention are described in various positions, and terms such as upper, lower, horizontal, etc., are used with reference to these positions. It will be understood, however, that the components may be manufactured and stored in orientations other than the ones described.

Figure 1:
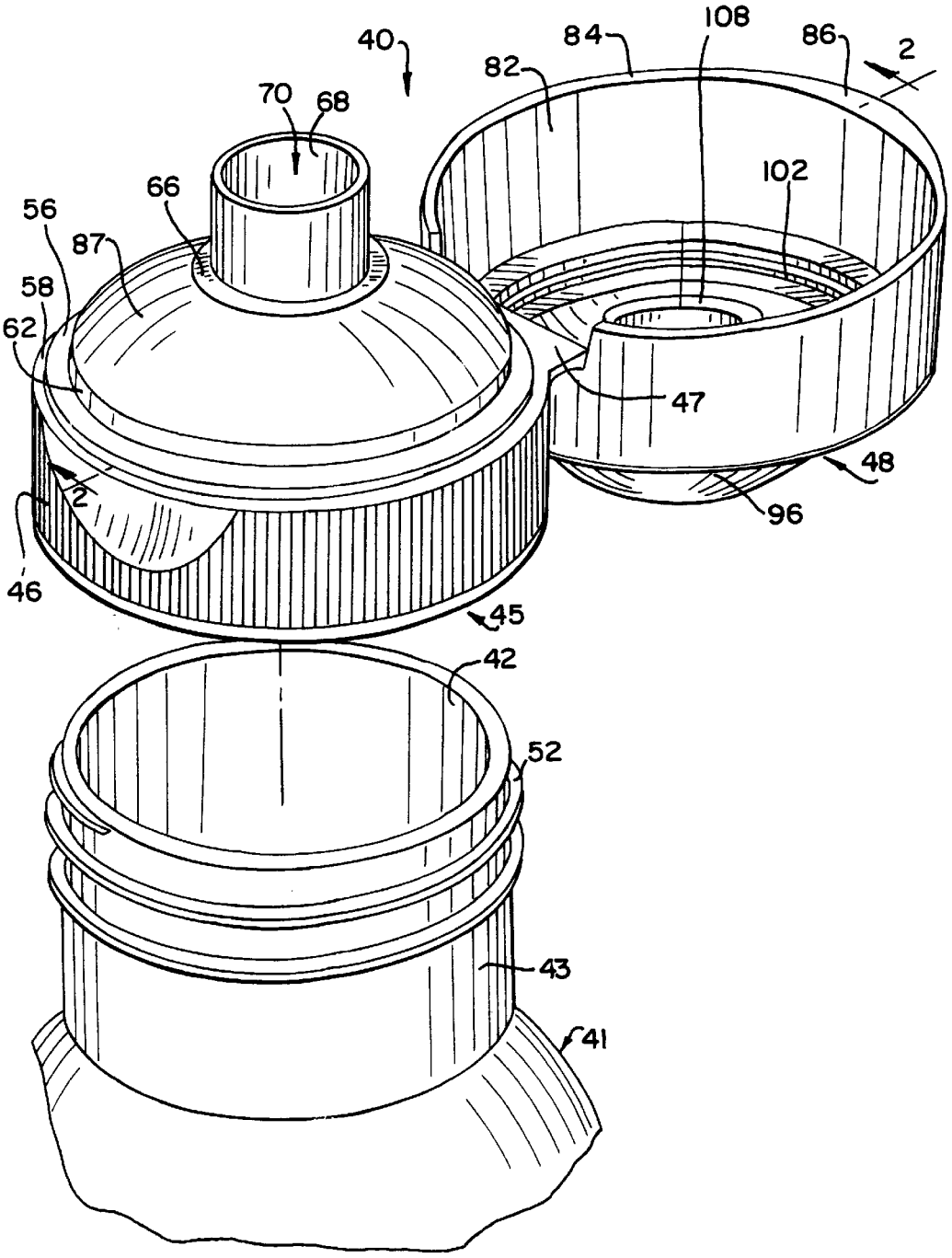
FIG. 1 is an exploded, fragmentary, perspective view of a first embodiment of a dispensing structure of the present invention which comprises a separate closure which has an attached lid shown in the open position and which is adapted to be threadingly engaged with a container having an opening.

With reference to the figures, a first embodiment of a dispensing system of the present invention is illustrated in FIGS. 1–4. The first embodiment of the dispensing system or structure includes a closure 40 which is adapted to be mounted on a container 41 (FIG. 1).

Figure 2:
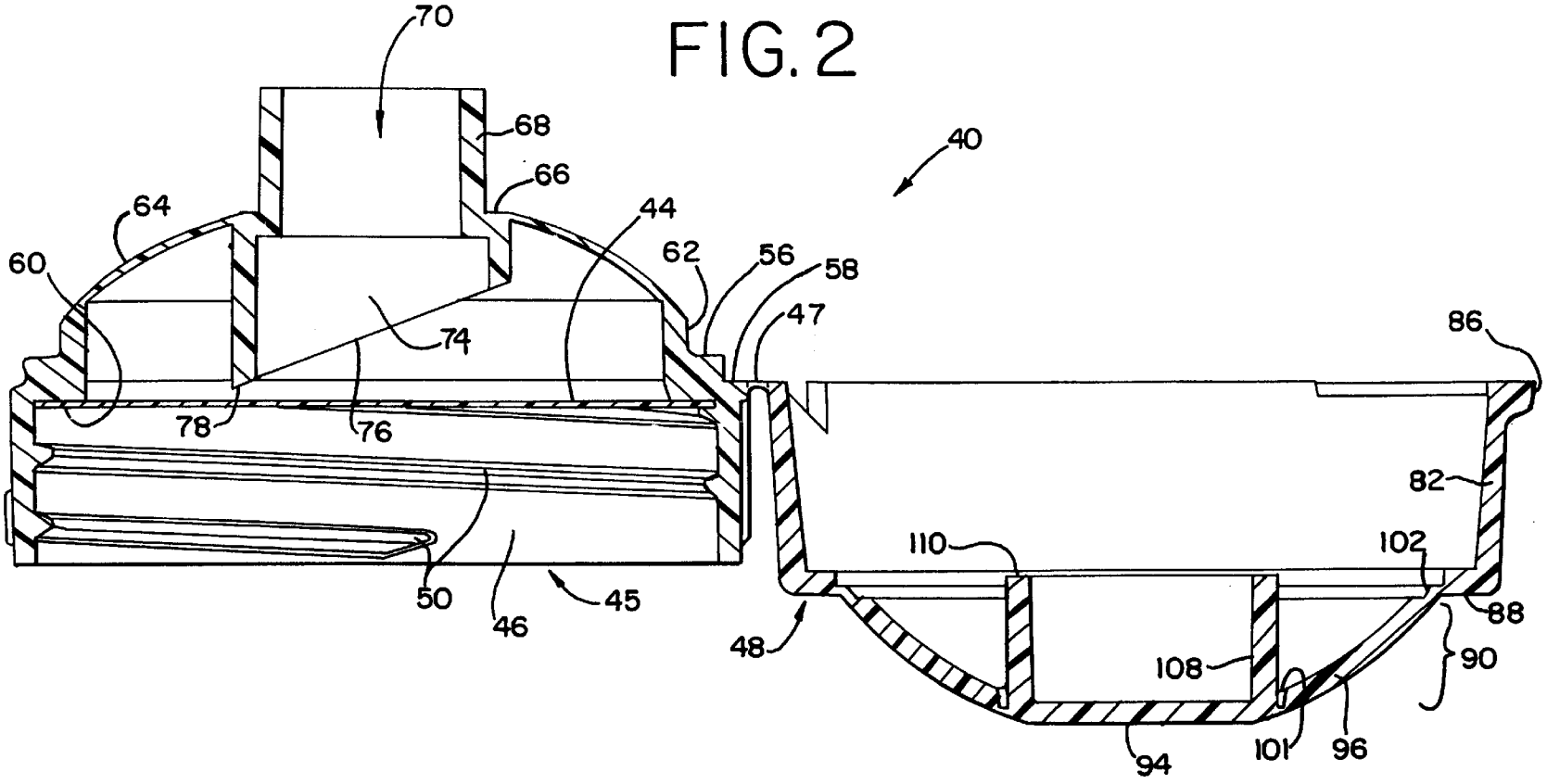
FIG. 2 is a fragmentary, cross-sectional view of the closure taken along the plane 2—2 in FIG. 1 prior to installation on a container.
Figure 3:
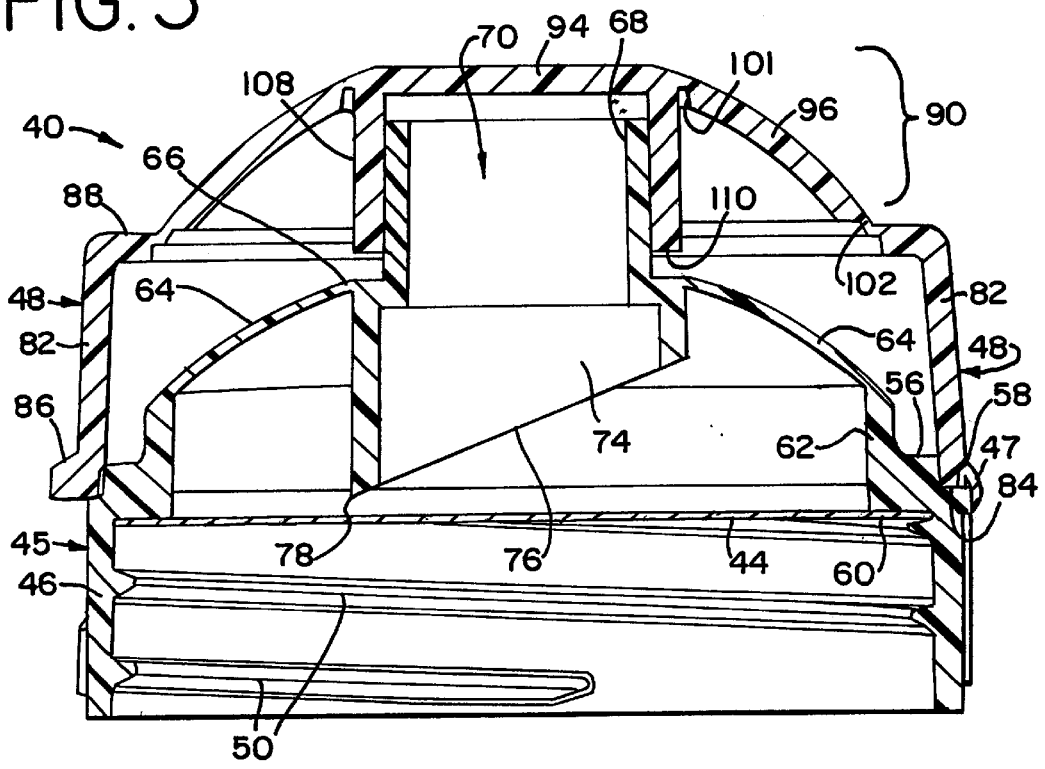
FIG. 3 is an enlarged, cross-sectional view similar to FIG. 2, but FIG. 3 shows the cover in the closed position.

The container 41 has a conventional mouth or opening 42 (FIG. 1) defined by a neck 43 or other suitable structure on the upper end of the container 41. Although the opening may initially be occluded by a membrane sealed to the top of the container neck 43, in the preferred embodiment illustrated in FIGS. 1–4, a membrane 44 is adhered to the closure 40 across an interior region of the closure 40 as shown in FIGS. 2 and 3 so that when the closure 40 is mounted on the container 41, the membrane 44 will seal across the container neck 43.

The membrane 44 may also be characterized as a "liner" or other barrier which may be a thermoplastic film or paper material. The membrane 44 may be heat-sealed or adhesively secured to the top of the container neck 43, to an interior region of the closure 40, or to both the container neck 43 and closure 40. Other suitable means of attaching the membrane 44 may be employed so long as a leak-tight seal is defined across the container neck opening 42 when the closure 40 is properly mounted to the container (or, alternatively, when the closure 40 is otherwise attached integrally to the container or formed as a unitary extension thereof).

According to one aspect of the present invention, the membrane 44 need not be characterized as part of the dispensing structure per se. The membrane 44 may be characterized as a separate element with which the present invention dispensing structure is adapted to coact as described in detail hereinafter.

The container neck 43 typically has (but need not have) a circular cross-sectional configuration, and the body of the container 41 may have another cross-sectional configuration, such as an oval cross-sectional shape, for example. The container mouth or opening 42 provides access to the container interior and to a product contained therein. The product may be, for example, a liquid comestible product. The product could also be any other solid, liquid, or gaseous material, including, but not limited to, a food product, a personal care product, an industrial or household cleaning product, or other chemical compositions, e.g., compositions for use in activities involving manufacturing, commercial or household maintenance, construction, remodelling, agriculture, etc.

The container 41 may typically be a squeezable container having a flexible wall or walls which can be grasped by the user and squeezed or compressed to increase the internal pressure within the container so as to force the product out of the container through the closure when the closure is open. The container wall typically has sufficient, inherent resiliency so that when the squeezing forces are removed, the container wall returns to its normal, unstressed shape. Such a squeezable wall structure is preferred in many applications, but may not be necessary or preferred in other applications. Other means could be provided for pressurizing the product inside the container in order to dispense the product. For example, a manually operable plunger or piston (not illustrated) could be provided at the bottom end of the container. In some applications, the container 41 can have rigid walls.

The closure 40 includes a body 45 having a skirt 46. The closure 40 also includes a cover 48. The cover 48 may be a separate element. However, preferably the cover 48 is connected to the top of the body skirt 46 with a hinge 47. Preferably, the hinge 47 is a snap-action hinge formed integrally with the cover 48 and body 45 in a unitary structure. The illustrated snap-action hinge 47 may be a conventional type as described in U.S. Pat. Nos. 4,403,712 or 5,642,824. Other hinge structures may be employed, including a "floppy" living film hinge. However, it is preferable to employ a snap-action hinge which can hold or maintain the cover 48 in the open position during the dispensing of the container contents at the application site.

The closure 45 (and hinge 47 and cover 48, if provided as a unitary part thereof) may be molded from a synthetic, thermoplastic, polymeric material, or other materials, compatible with the container contents. The body skirt 46 has suitable connecting means (e.g., a conventional thread 50 (FIGS. 2 and 3) or a conventional snap-fit bead (not illustrated)) for engaging suitable cooperating means, such as a thread 52 (FIG. 1) (or bead (not illustrated)) on the container neck 43 to secure the closure body 45 to the container 41.

The closure body 45 and container 41 could also be connected with other systems. For example, they could be welded together by induction-melting or ultrasonic melting. With such other connection systems, the configuration of the body skirt 46 may be altered, or the skirt 46 may be eliminated altogether. In some applications, it may be desirable to provide the closure body 45 as a direct extension of the container 41. For example, a portion of the closure body 45 may be initially molded from thermoplastic material as a unitary extension of the container 41, and subsequently, the membrane 44 could be positioned and fixed within the body 45 or container neck from a temporarily open bottom end of the container prior to the contents being added to the container through the temporarily open bottom end of the container and prior to the bottom end of the container being molded closed.

As shown in FIG. 3, the top of the body skirt 46 includes two outer, annular shoulders: an upper, outer annular shoulder 56 and a lower, outer annular shoulder 58. The shoulders 56 and 58 are concentric. The upper, outer annular shoulder 56 has a downwardly or inwardly facing bearing surface 60. The closure body 45 is adapted to be mounted to the container 41 with the membrane 44 initially sealed to the downwardly facing bearing surface 60. The bearing surface 60 thus engages and is sealed to, an outwardly facing, annular, peripheral region of the membrane 44, and the bearing surface 60 serves to hold the membrane 44 tight against the top of the container neck 42 when the closure 40 is mounted on the container 41.

The body 45 includes an annular, peripheral wall 62 extending upwardly from the inner diameter of the upper, annular shoulder 56. The annular wall 62 functions as an anchor for a flexible panel 64 which extends from the top of the wall 62. The flexible panel 64 has a generally dome-like configuration and terminates on an inner diameter at an inner shoulder 66 projecting from the base of an outwardly extending spout 68 which defines a dispensing aperture 70. A penetrator 74 extends inwardly (i.e., downwardly in FIG. 3) from the inner diameter of the panel 64.

The flexible panel 64 is normally biased to an outwardly displaced configuration as viewed from outside the body 45. The flexible panel 64 is relatively thin and accommodates movement of the panel 64 to an inwardly displaced configuration (FIG. 4) when the cover 48 is pushed downwardly against the panel 64 as described in detail hereinafter.

Preferably, the penetrator 74 is an annular wall extending inwardly (i.e., downwardly) as a unitary extension of the inner, annular shoulder 66. The penetrator 74 has a bottom edge 76 for piercing or severing a central portion of the membrane 44. The bottom edge 76 of the penetrator 74 has a sloping or slanting orientation which lies at an oblique angle to the membrane 44. The bottom edge 76 of the penetrator 74 has a lowermost portion 78 (FIG. 3) which defines an acute angle piercing edge portion for initially contacting, and then piercing or severing, the membrane 44.

The closure cover 48 includes a skirt 82 (FIG. 1) which defines a bearing surface 84. As shown in FIG. 3, the cover bearing surface 84 is adapted to seat on the closure body lower, outer shoulder 58 when the cover 48 is closed. On one side of the closure 40, the cover skirt 82 is joined in a unitary manner to the hinge 47. 180 degrees from the hinge 47, there is an outwardly extending lip 86 (FIG. 3), and the user may lift the cover 48 upwardly by pushing on the underside of the lip 86 with a thumb or finger.

The outer or upper end of the cover skirt 82 terminates in an annular flange or shoulder 88 (FIG. 3). Together, the shoulder 88 and skirt 82 constitute a peripheral frame from which a convex top 90 extends (FIGS. 2 and 3). The top 90 is characterized as being generally "convex" in an initially, unactuated position as shown in FIG. 3 when viewed from the exterior of the cover 48. The top 90 is normally biased to the outwardly convex configuration and accommodates flexure of the top 90 to a self-maintained, inverted, inwardly concave configuration (FIG. 4) for moving the body panel 64 to the inwardly displaced configuration (FIG. 4) wherein the penetrator 74 penetrates the membrane 44.

In the preferred embodiment, the convex top 90 includes a flat, disk-like central region 94, an annular region 96, a first annular hinge 101 joining the central region 94 with the annular region 96, and a second annular hinge 102 joining the annular region 96 with the flange 88 (which flange 88, together with the cover skirt 82, defines the peripheral frame of the cover 48).

In the preferred embodiment, the annular region 96 has an arcuate cross-section which has a generally uniform thickness between the first annular hinge 101 and the second annular hinge 102. Each annular hinge 101 and 102 includes a reduced thickness section of material defined by a notch which opens inwardly toward the inside of the cover 48.

In the preferred embodiment, a force transfer ring or annular collar 108 extends inwardly from the periphery of the top central region 94 for receiving the closure body spout 68 when the cover 48 is in the closed position. The bottom of the cover annular collar 108 defines an annular, inner end 110 which is adapted to engage the upwardly facing shoulder 66 around the closure body spout 68 when the cover 48 is actuated by being pushed downwardly as shown in FIG. 4.

Figure 4:
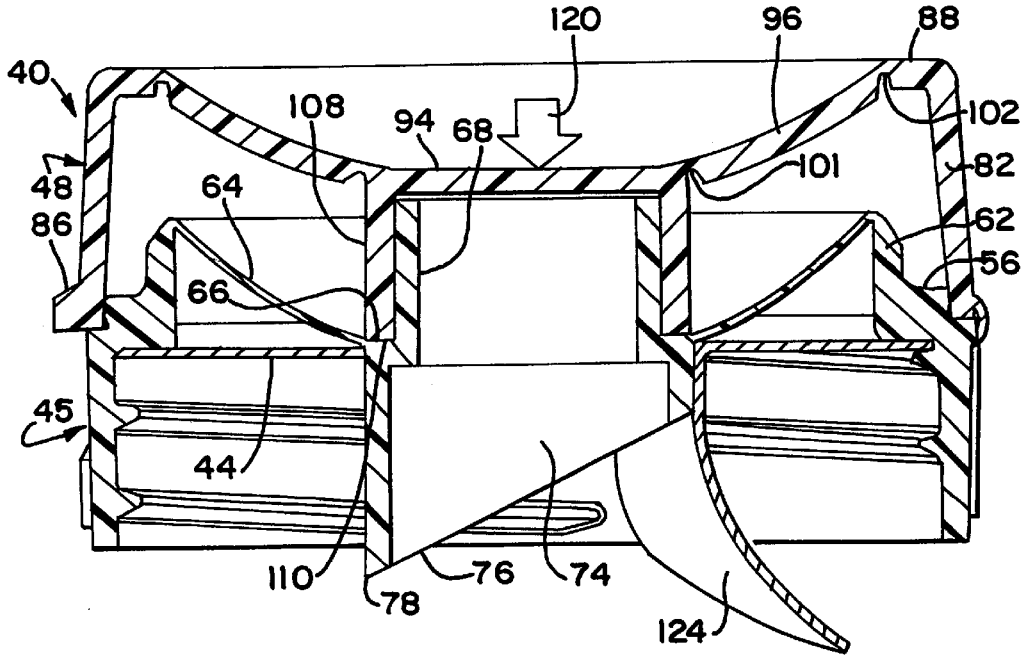
FIG. 4 is a view similar to FIG. 3, but FIG. 4 shows the cover pushed downwardly to force the body penetrator through the membrane.

The cover top hinges 101 and 102 accommodate movement of the annular region 96 from the outwardly convex configuration (FIG. 3) to a self-maintained, inverted, inwardly concave configuration (FIG. 4) when the exterior surface of the cover central region 94 is subjected to a downwardly directed force represented by the arrow 120 in FIG. 4. Typically, a user would push down on the central region 94 with the heel or palm of the user's hand or with the thumb or a finger of the user's hand. The downward movement of the closure body penetrator 74 effects a piercing or severing of the membrane 44. In the fully actuated configuration as illustrated in FIG. 4, the components remain in that position owing to the self-biasing nature of the inverted cover annular region 96 and annular hinges 101 and 102, and owing to the friction between the cylindrical, exterior surface of the penetrator 74 and the surrounding membrane 44.

The cover top 90 (FIG. 3) has two stable positions—the outwardly convex configuration illustrated in FIG. 3, and the inwardly concave configuration illustrated in FIG. 4. At any position between the two stable positions, the top 90 is in compression and exhibits a resistance to movement between the two stable positions. The degree of resistance to movement may be defined, at least in part, by the differential surface areas of the annular region 96 and the areas defined by the film hinges 101 and 102. As the top 90 is pushed from one stable position to the other stable position, the resistance to movement is overcome by resilient compressive bowing and distortion which is accommodated by the resilient material of the cover 48 (which may be polypropylene, for example) and by the film hinges 101 and 102.

Owing to the configuration of the penetrator 74, the penetration of the membrane 44 results in the formation of a downwardly hanging flap portion 124 (FIG. 4). The interior of the container is then in communication, through the penetrated membrane 44, with the inside of the penetrator 74 and with the inside of the spout 68. Next, the cover 48 can be lifted upwardly by the user to open the closure. Owing to the friction between the exterior surface of the penetrator 74 and the membrane 44, the closure body flexible panel 64 remains in the inwardly displaced configuration (FIG. 4) as the cover collar 108 slides upwardly and away from the closure body spout 68. Subsequently, the container 41 can be inverted to accommodate the dispensing of the product out of the container through the open spout 68. In the preferred embodiment, where the hinge 47 is a snap-action type of hinge, the cover 48 is generally held in a self-maintained open position by the hinge 47.

The unique structure of the cover top 90 described above provides a large surface area upon which the user may exert a force to invert the top 90 and underlying flexible panel 64 when puncturing the membrane 44. The cover top 90 provides a number of functions. First, the top 90 provides a large bearing surface for user comfort during application of force to actuate the closure 40 when opening the membrane 44. Second, the top 90 provides an attachment means for the dispensing aperture sealing collar 108. Third, the top 90 provides the two-position biasing feature for holding the closure cover in the self-maintained, outwardly convex configuration or in the self-maintained inverted, inwardly concave configuration. Finally, owing to the self-biasing nature of the top 90 as it snaps from one stable position through its range of motion to the other stable position, the top 90 functions as a force-enhancing means for actuation of the closure. In particular, it will be appreciated that as the top 90 moves from its outwardly convex configuration (FIG. 3) to its inverted, inwardly concave configuration (FIG. 4), the top 90 passes through a point of maximum distortion and stress which provides a maximum spring force. This has a tendency to accelerate the movement of the top 90 toward the inwardly concave configuration. This acceleration enhances the force exerted by the user on the closure cover 48, and this enhances the piercing force of the penetrator 74 on the membrane 44.

Once the cover has been actuated to the self-maintained, inverted, inwardly concave configuration (FIG. 4), the cover 48 remains in that configuration—even when the lid 48 is lifted upwardly to open the spout 68 because of the friction between the exterior of the penetrator 74 and the surrounding membrane 44. Thus, the container 41, with an actuated closure 40 mounted thereon can be stored, if desired, on a shelf or other surface in an upsidedown orientation on the cover shoulder 88. This permits the product within the container to flow down to the region of the spout 68 under the influence of gravity so that the product can be readily discharged from the container 41 when the cover 48 is subsequently opened. This is especially useful with viscous products which can take a long time to flow from the bottom of a container to the container spout.

The closure body flexible panel 64 with the attached penetrator 74 and spout 68 provides a number of functions. First, it provides a means for attaching the penetrator 74 to the closure. Second, it provides a means for positioning the penetrator 74. Third, it provides a travel control means for controlling the movement of the penetrator 74 from the outwardly displaced configuration to the inwardly displaced configuration. Finally, it functions in cooperation with the cover 48 to maintain the integrity of the closure product containment before, during, and after the membrane penetration process so long as the cover 48 is in the closed configuration over the closure body 45.

The closure of the present invention can be readily incorporated in a number of alternate embodiments which are illustrated in FIGS. 5–13. In FIGS. 5–13 the same reference numbers are used for elements which are identical or functionally analogous to corresponding elements in the first embodiment illustrated in FIGS. 1–4. The reference numbers for each alternate embodiment are, however, also provided with a different suffix letter corresponding to the particular alternate element.

Figure 5:
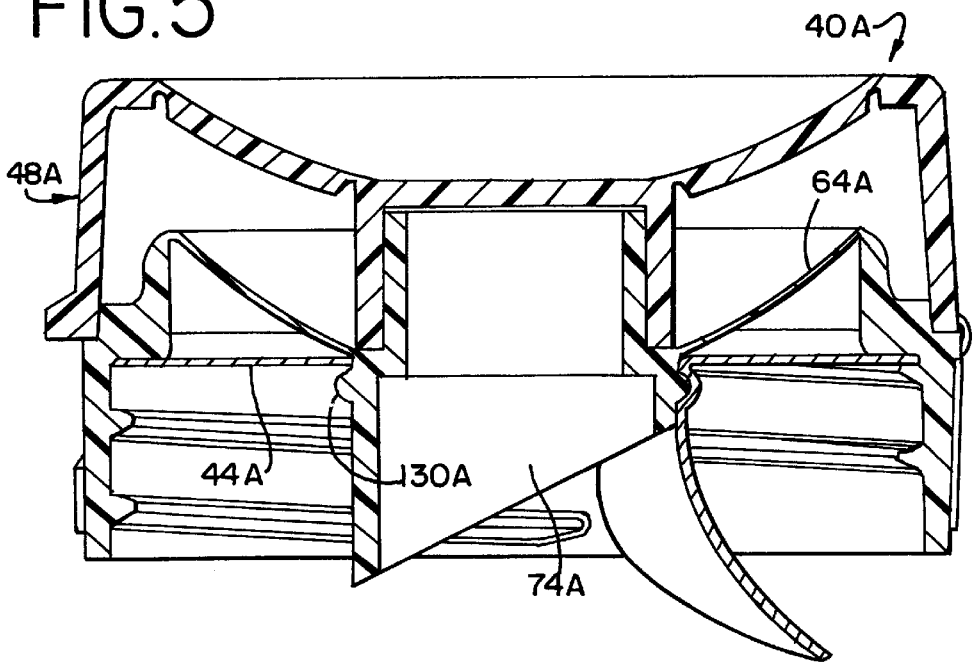
FIG. 5 is a view similar to FIG. 4, but FIG. 5 shows a second embodiment of the invention.

Specifically, FIG. 5 illustrates a second embodiment of the invention in the form of a closure 40A which is in all respects identical with the first embodiment of the closure 40 described above with reference to FIGS. 1–4, except that the closure 40A includes a radially extending, annular rib 130A on the penetrator 74A. The rib 130A is forced through the membrane 44A and subsequently engages the membrane 44A around the periphery of the hole cut therein by the penetrator 74A. This provides greater resistance to withdrawal of the penetrator 74A from the membrane 44A and resists movement of the closure body flexible panel 64A to the outwardly displaced configuration when the lid 48A is opened.

Figure 6:
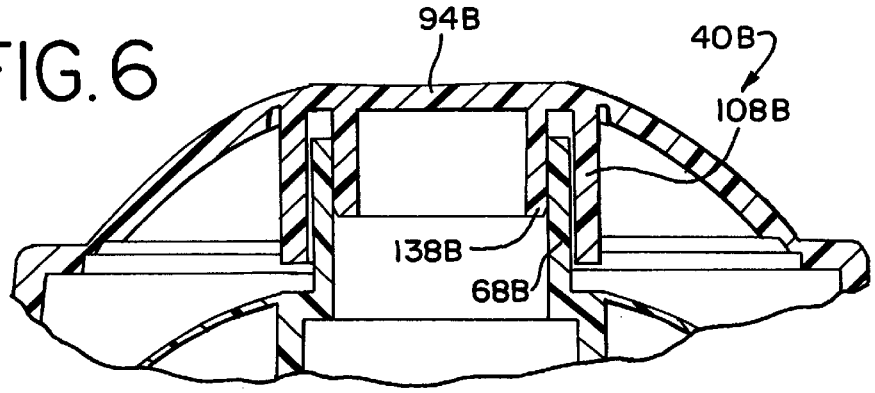
FIG. 6 is a view similar to FIG. 3, but FIG. 6 shows a third embodiment of the invention.

FIG. 6 illustrates a third embodiment of the invention in the form of a closure 40B which is identical with the first embodiment of the closure 40 described above with reference to FIGS. 1–4, except that the third embodiment closure 40B has an inwardly extending, annular sealing spout 138B which projects inwardly from the cover top central portion 94B to provide an interior seal along the interior, cylindrical surface of the spout 68B. In the third embodiment, there is also an annular clearance between the exterior, cylindrical surface of the spout 68B and the interior, cylindrical surface of the surrounding annular collar 108B.

Figure 7:
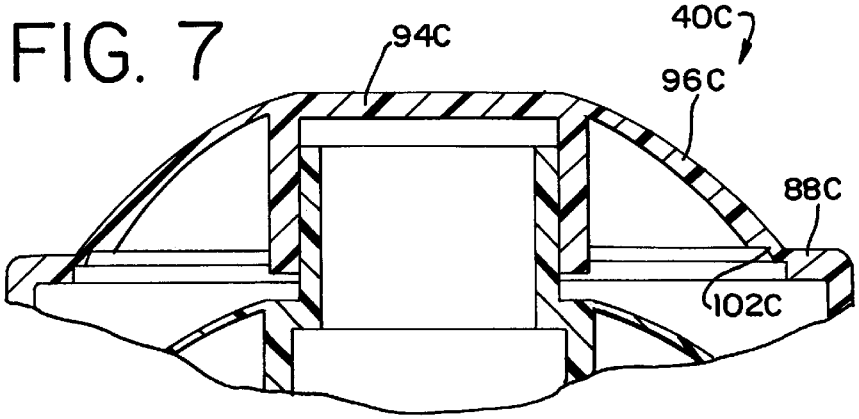
FIG. 7 is a fragmentary view similar to FIG. 3, but FIG. 7 shows a fourth embodiment of the invention.

A fourth embodiment of the invention is illustrated in FIG. 7 in the form of a closure 40C which is identical with the first embodiment of the closure 40 illustrated in FIGS. 1–4, except that the closure 40C has only one annular hinge 102C joining the annular region 96C to the cover shoulder 88C at the outer diameter of the annular region 96C. The annular region 96C gradually decreases in thickness toward the inner diameter thereof where it joins the central region 94C.

Figure 8:
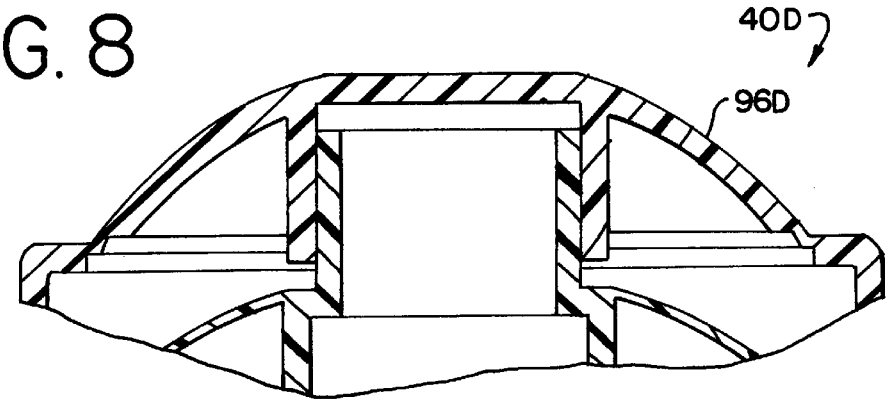
FIG. 8 is a fragmentary view similar to FIG. 3, but FIG. 8 shows a fifth embodiment of the invention.

FIG. 8 illustrates a fifth embodiment of the present invention in the form of a closure 40D which is substantially identical with the fourth embodiment of the closure 40C described above with reference to FIG. 7, except that the fifth embodiment of the closure 40D has an annular region 96D with a generally uniform cross-sectional thickness.

Figure 9:
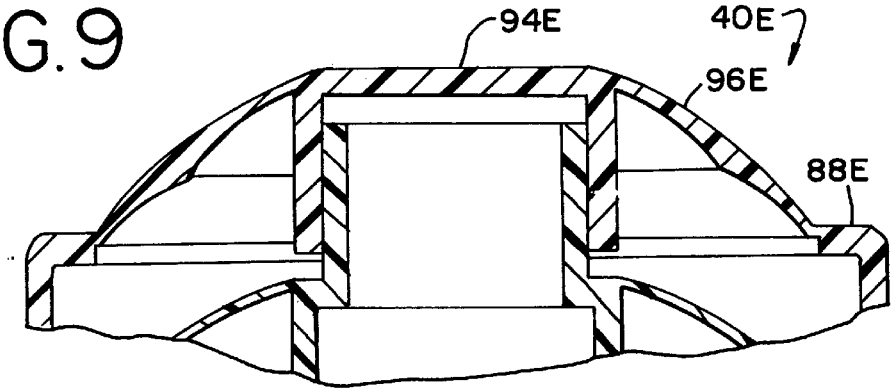
FIG. 9 is a fragmentary view similar to FIG. 3, but FIG. 9 shows a sixth embodiment of the invention.

FIG. 9 illustrates a sixth embodiment of the present invention in the form of a closure 40E which is similar to the first embodiment of the closure 40 described above with reference to FIGS. 1–4, except that the closure 40E includes a cover annular region 96E which has a thicker middle section and thinner peripheral regions instead of hinges joining annular region 96E to the cover central region 94E and to the cover peripheral frame shoulder 98E.

Figure 10:
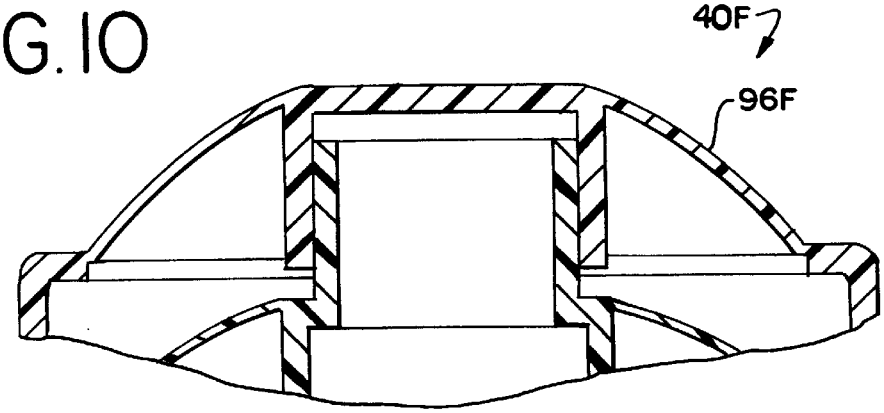
FIG. 10 is a fragmentary view similar to FIG. 3, but FIG. 10 shows a seventh embodiment of the invention.

FIG. 10 illustrates a seventh embodiment of the present invention in the form of a closure 40F which is similar to the sixth embodiment described above with reference to 9, except that the seventh embodiment closure 40F has an annular region 96F which has a uniform, but relatively thin, transverse cross section. In a presently contemplated embodiment, the thickness of the annular region 96F may be between about 0.010 inch and about 0.025 inch.

Figure 11:
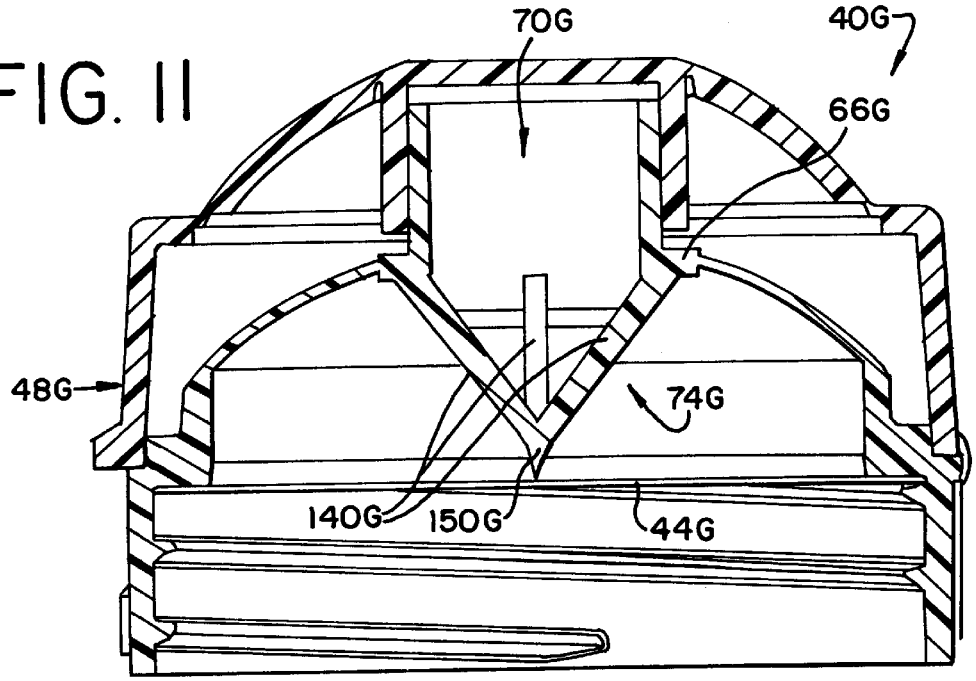
FIG. 11 is a view similar to FIG. 3, but FIG. 11 shows an eighth embodiment of the invention.
Figure 12:
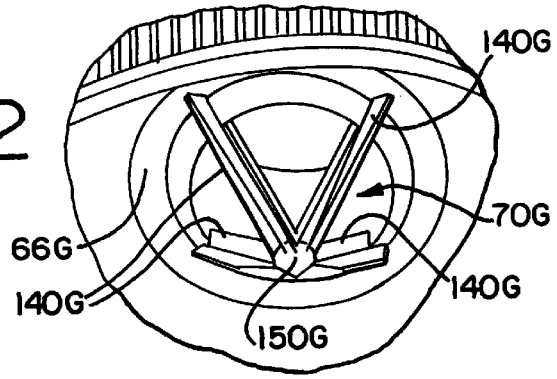
FIG. 12 is a fragmentary, perspective view of the underside of the closure body shown in FIG. 11.
Figure 13:
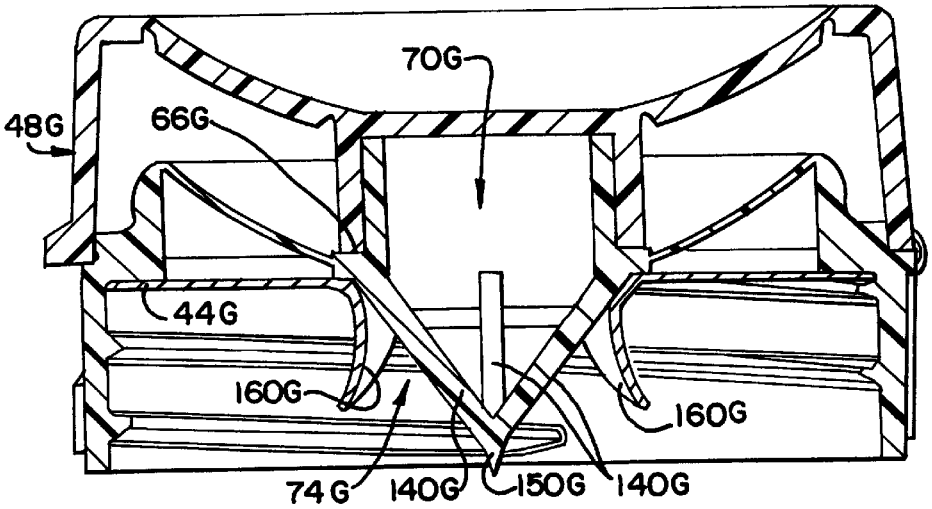
FIG. 13 is a view similar to FIG. 11, but FIG. 13 shows the closure pushed downwardly to effect penetration of the membrane.

An eighth embodiment of the present invention is illustrated in FIGS. 11–14 in the form of a closure 40G. The closure 40G is identical in all respects with the first embodiment of the closure 40 described above with reference to FIGS. 1–4, except that the closure 40G has a penetrator 74G which is different from the penetrator 74 of the first embodiment closure 40. In particular, as shown in FIGS. 11–13, the penetrator 74G includes a plurality of struts 140G which are arranged in a conical array, with one end of each strut 140G joining the underside of the body shoulder 66G adjacent a periphery of the dispensing aperture 70G and with the other end of each strut 140G merging with the other struts 140G to define a piercing member 150G. When the closure 40G is actuated by pushing the closure cover 48G into the inwardly concave configuration, the penetrator 74G is pushed through the membrane 44G which is severed or torn into a plurality of downwardly hanging flaps 160G (FIG. 13).

It will be readily observed from the foregoing detailed description of the invention and from the illustrations thereof that numerous other variations and modifications may be effected without departing from the true spirit and scope of the novel concepts or principles of this invention.

What is claimed is:

1. A dispensing structure for a container that has an opening to the container interior which can be initially closed by a membrane occluding said opening, said dispensing structure comprising:

a body for extending around said container opening over said membrane, said body including (a) a peripheral wall, (b) a flexible panel that (i) is connected with said peripheral wall, (ii) extends around a dispensing aperture, (iii) is normally biased to an outwardly displaced configuration as viewed from outside said body, and (iv) accommodates movement of said panel to an inwardly displaced configuration, and (c) a penetrator extending inwardly from said panel for penetrating said membrane when said panel is in said inwardly displaced configuration; and a cover for accommodating movement between (1) a closed position over said body, and (2) an open position away from said closed position, said cover including (a) a peripheral frame mounted on said body, and (b) a convex top that (i) is connected with said frame, (ii) is normally biased to an outwardly convex configuration as viewed from outside said cover, and (iii) accommodates flexure of said top to a self-maintained, inverted, inwardly concave configuration for moving said body panel to said inwardly displaced configuration wherein said penetrator penetrates said membrane.

2. The dispensing structure in accordance with claim 1 in which said dispensing structure body is formed separately from said container; and said membrane is a separate component initially sealed to said dispensing structure body inwardly of said penetrator to occlude flow through said dispensing aperture when said dispensing structure body is mounted on said container.

3. The dispensing structure in accordance with claim 1 in which said dispensing structure body is separate from said container and includes a skirt with an interior thread for threadingly engaging an exterior thread on said container.

4. The dispensing structure in accordance with claim 1 in which said body has an outer annular shoulder with an inwardly facing bearing surface; and said body is adapted to be mounted to said container with said membrane initially sealed to said container over said opening to occlude said opening so that said body shoulder bearing surface engages an outwardly facing, annular, peripheral region of said membrane.

5. The dispensing structure in accordance with the claim 1 in which said container has an end defining said opening; and said dispensing structure body extends from said container as a unitary part of said container end.

6. The dispensing structure in accordance with claim 1 in which said cover frame includes a peripheral shoulder and a skirt extending from said shoulder for engaging said body.

7. The dispensing structure in accordance with claim 1 in which said penetrator includes an inner, annular wall around said dispensing aperture and includes an edge defined along a bottom portion of said inner, annular wall at an oblique angle to said membrane.

8. The dispensing structure in accordance with claim 1 in which said penetrator includes a plurality of struts arranged in a conical array with one end of each said strut joining said body adjacent the periphery of said dispensing aperture and with the other end of each said strut merging with the other struts to define a piercing member.

9. The dispensing structure in accordance with claim 1 in which said dispensing structure body and cover are molded as a unitary structure joined by a snap-action hinge.

10. The dispensing structure in accordance with claim 1 in which said body is generally dome-shaped when said panel is normally biased in said outwardly displaced configuration.

11. The dispensing structure in accordance with claim 1 in which said cover top includes (1) a central region, (2) an annular region, (3) a first annular hinge joining said central region with said annular region, and (4) a second annular hinge joining said annular region with said cover frame.

12. The dispensing structure in accordance with claim 11 in which each said first and second annular hinge is a generally annular, reduced thickness, film hinge.

13. The dispensing structure in accordance with claim 1 in which said cover top includes an annular region defined between two, spaced-apart, generally concentric film hinges.

14. The dispensing structure in accordance with claim 1 in which said cover top is generally dome-shaped.

15. The dispensing structure in accordance with claim 1 in which said body flexible panel has a uniform thickness.

16. The dispensing structure in accordance with the claim 1 in which said dispensing structure body includes a peripheral skirt that extends downwardly past the periphery of said membrane when said body is disposed on said container.

17. The dispensing structure in accordance with claim 1 in which said cover top includes an annular region which is flexible and has a non-uniform thickness.

18. The dispensing structure in accordance with claim 1 in which said body includes an annular dispensing spout extending outwardly from said panel around said dispensing aperture;

said body has an annular shoulder extending radially from the base of said spout;

said cover includes a flat, disk-shaped central region and an annular collar extending inwardly around said body spout; and said cover annular collar has an annular inner end for engaging said body annular shoulder when said cover is pushed inwardly toward said body spout.

19. The dispensing structure in accordance with claim 1 in which said penetrator includes a radially extending, annular rib which can be forced through a hole cut by said penetrator in said membrane and which can subsequently engage said membrane around the periphery of said hole to resist withdrawal of said penetrator from said membrane.

20. A dispensing structure for a container that has an opening to the container interior which can be initially closed by a membrane occluding said opening, said dispensing structure comprising:

a body for extending around said container opening over said membrane, said body including (a) a peripheral wall, (b) a flexible panel that (i) is connected with said peripheral wall, (ii) extends around a dispensing aperture, (iii) is normally biased to an outwardly displaced configuration as viewed from outside said body, and (iv) accommodates movement of said panel to an inwardly displaced configuration, and (c) an annular dispensing spout extending outwardly from said panel around said dispensing aperture, (d) an annular shoulder extending radially from the base of said spout, and (e) a penetrator extending inwardly from said panel for penetrating said membrane when said panel is in said inwardly displaced configuration; and a cover for accommodating movement between (1) a closed position over said body, and (2) an open position away from said closed position, said cover including (a) a peripheral frame mounted on said body, and (b) a convex top that is normally biased to an outwardly convex configuration as viewed from outside said cover and that accommodates flexure of said top to a self-maintained, inverted, inwardly concave configuration for moving said body panel to said inwardly displaced configuration wherein said penetrator penetrates said membrane, said top including (i) a flat, disk-shaped central region, (ii) a generally annular, deflectable region connected along a small diameter to said central region and connected along a larger diameter to said cover frame, and (iii) an annular collar that extends inwardly around said body spout when said cover is in said closed position and that has an annular inner end for engaging said body annular shoulder when said cover is pushed inwardly toward said body spout.

* * * * *